US005171924A

United States Patent [19]

Honey et al.

[11] Patent Number: 5,171,924

[45] Date of Patent: Dec. 15, 1992

[54] FLAGGED FIREARM LOCK METHOD AND APPARATUS

[75] Inventors: Michael T. Honey, Boca Raton, Fla.; Kendall S. Osborne, Fresno, Calif.; Richard D. Ruston, Auburn, N.Y.

[73] Assignee: Aero Finance Group Inc./dba Kiss Lock Enterprises, Ft. Lauderdale, Fla.

[21] Appl. No.: 665,529

[22] Filed: Mar. 6, 1991

[51] Int. Cl.[5] ..... F41B 17/44

[52] U.S. Cl. ..... 42/70.11; 42/66

[58] Field of Search ..... 42/70.11, 66

[56] References Cited

U.S. PATENT DOCUMENTS

| | | | |
|---|---|---|---|
| 2.836,918 | 6/1958 | Pula et al. | 42/70.11 |
| 3.154,874 | 11/1964 | Stewart | 42/70.11 |
| 4.479,320 | 10/1984 | Fix | 42/70.11 |
| 4.512,099 | 4/1985 | Mathew | 42/70.11 |
| 4.908,971 | 3/1990 | Chaney | 42/70.11 |
| 5,001,854 | 3/1991 | Derman | 42/70.11 |
| 5,048,211 | 9/1991 | Hepp | 42/70.11 |
| 5,054,223 | 10/1991 | Lee | 42/70.11 |

OTHER PUBLICATIONS

News Release, Ft. Lauderdale, Fl., Dec. 21, 1990, Kiss Lock Enterprises, "Unique Lock Protects Children From Gun Accidents".

*Primary Examiner*—Michael J. Carone

[57] ABSTRACT

The invention comprises a system for facilitating the locking of a firearm to prevent its unauthorized firing. The system provides an easily noticeable flagging device to facilitate visual affirmation that a firearm lock is engaged; and the firearm cannot be discharged until it has been unlocked. The locking system utilizes a locking wedge that activates a set of locking spurs so as to engage the interior of the firearm and disable the firing mechanism. The system provides for quick and simple enabling of the firearm to facilitate a quick response in an emergency. The system makes use of a locking device that can be inserted or extracted through the barrel of a firearm using a key rod. The locking device is not readily apparent or accessible externally to an observer. The system may be used to lock a firearm that is either loaded or empty, although it is obviously preferable and a proper precuation to apply the system only to empty firearms.

4 Claims, 4 Drawing Sheets

FIG.5
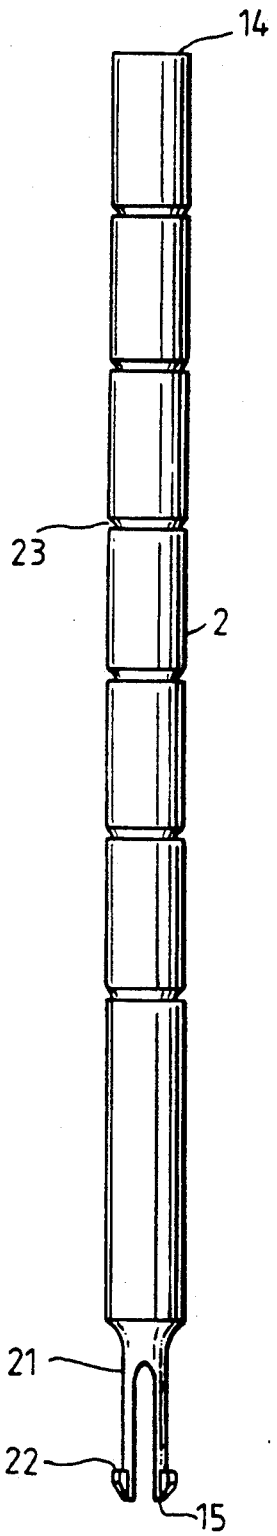
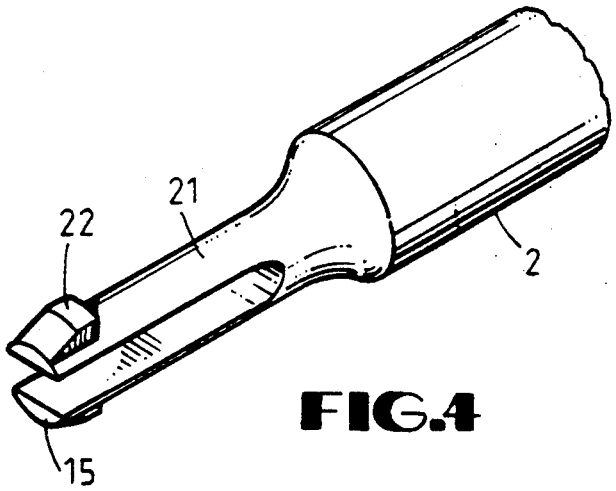
FIG.4
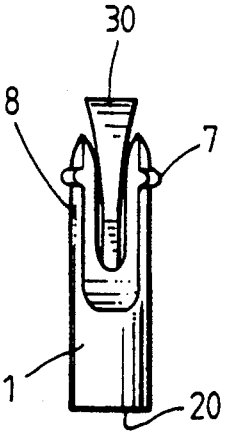
FIG.6
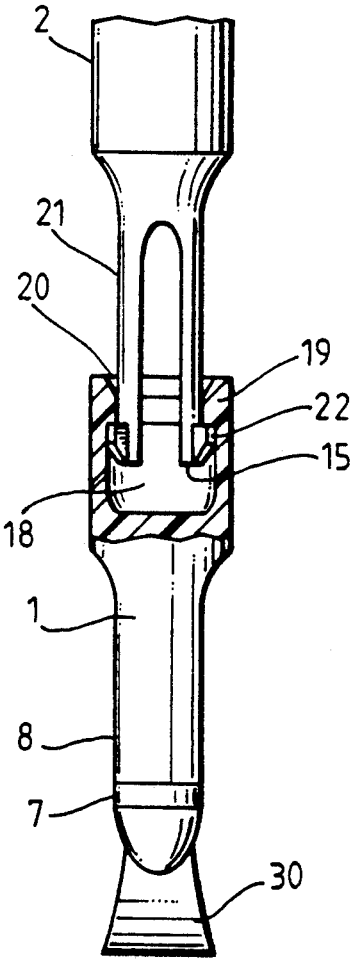
FIG.7

FLAGGED FIREARM LOCK METHOD AND APPARATUS

BACKGROUND OF THE INVENTION

1. Field of the Invention

The invention relates generally to a system capable of locking firearms so they can not be fired, but also capable of being easily unlocked so as to be rapidly made ready for firing. The invention is especially directed at use in rifles, revolvers, semi-automatic pistols and comparable firearms.

2. Description of the Related Art

Until now a firearm owner has faced the dilemma of leaving a firearm either loaded and ready to use, or else unloaded or locked so as to be not readily accessible. Previous systems of locking firearms may well have prevented the danger of access by unauthorized users or children, but unfortunately they have suffered from a number of shortcomings. In many applications, for example, a firearm safety locking system should be simple to operate but also quickly disengaged to be truly effective. Preferably, it should also be useful with a variety of firearms in both empty and loaded conditions.

Equipment designers, military trainers, police and emergency response groups have established over years of experience that persons under stress in emergency situations suffer greatly diminished coordination and dexterity. Trying to operate cumbersome firearm combination locks or even keyed locks under such conditions can be difficult if not impossible. A firearm should therefore be quickly unlocked and also quickly enabled; otherwise, it may prove useless in an emergency.

On the other hand a firearm locking system should not be easily defeated; otherwise, a firearm can become a risk to children who discover the firearm. It is well known that this risk is especially great when the children are home alone and unsupervised.

A firearm locking system should also make it readily obvious to its owner whether or not the firearm is locked but should not be obvious to others. The firearm lock should not offer an external point of attack. The firearm lock should also not be susceptible to failure and should be capable of locking firearms whether or not they are loaded.

Many safety devices for firearms have been developed which include plugs or locks of various configurations adapted to be installed within the barrel or a chamber so as to prevent loading a round of ammunition into the firearm. Other types of safety devices include a cartridge or thimble secured to a rod, the cartridge being adapted to fit within the firing chamber with the rod extending through the barrel and locked by a locking mechanism. An example of such a device is shown in Parker U.S. Pat. No. 2,327,334, wherein the locking device is shown installed in a revolver. While the Parker installed locking device prevents loading and rotation of the cylinder, it is apparent that the revolver must be of the break action or pivot type since the locking device must be inserted and removed through the rear of the cylinder. Thus, the Parker locking device is not designed for use in rigid frame revolvers in which the cylinder is mounted for pivoting with respect to the revolver frame.

Numerous other examples of firearm locking devices are shown in Finnegan, U.S. Pat. No. 3,336,880, Di Prospero U.S. Pat. No. 3,813,802, Bielman U.S. Pat. No, 4,224,753, Wernicki U.S. Pat. No. 4,398,366, Thurber U.S. Pat. No. 4,783,924 and Chaney U.S. Pat. No. 4,908,971. All of these examples, however, are subject to one inconvenience or another. Devices such as Bielman, for example, are externally visible and externally accessible, thereby offering an external point of attack and greatly facilitating the defeat of the locking device.

Other devices can only be used in an empty chamber, thereby reducing the cartridge capacity of a firearm. Many of the devices are also cumbersome and complicated to disengage.

U.S. patent application Ser. No. 07/530,408 filed May 30, 1990, for Grider and assigned to Aero Finance Corporation, Delaware, discloses an easily removable firearm lock that overcomes many of the shortcomings of the prior art. The present invention is an improvement over Grider and the prior art.

SUMMARY OF THE INVENTION

In general terms, the present invention comprises a locking member and a key member which are inserted into a firearm through its barrel. The key member pushes the locking member such that the leading end of the locking member partially enters a chamber of the firearm. The locking member is preferably designed such that its leading end penetrates into the chamber farther if the chamber is empty, than if the chamber is loaded. In either case, the locking member is configured to grip or otherwise engage the inner wall surface of the bullet path of the firearm—i.e., the wall surface of the chamber (or the barrel) so as to block relative movement between the chamber and the barrel. The firearm's ability to fire is thereby disabled.

The locking member of the present invention is effectively a retractable wall anchor which comprises a body portion whose leading end includes one or more radially and elastically expansible fingers, arms or other gripping or anchor members which expand to engage suitable anchorage points in the wall of the bullet path. The locking member or wall anchor also preferably includes a centrally disposed wedge at its leading end which is configured to engage either the head of a bullet in a chamber, or the back of the chamber itself if no bullet is present in the chamber. The trailing or other end of the wedge is axially movable within the body of the locking member between two axially spaced positions. The leading end of the wedge is the broad end of the wedge and normally protrudes beyond the body and the expansible members. It is preferably broad enough such that the head of a bullet cannot penetrate between the wedge and the wall surface of the chamber.

The trailing end of the wedge tapers inwardly and extends between the expansible anchor members along the axis of the locking member. Thus, telescoping movement of the wedge within the body results in expansion of the expansible elements into an anchoring position against the wall of the bullet path. Preferably, the anchor position is either the forcing cone normally between the chamber and the barrel or else a position deep within the chamber.

The wall anchor members may vary considerably in structure and composition. Flexible tough plastic materials such as Nylon are relatively inexpensive and easy to make, and they have been found to be reliable in service. These materials are also resilient and have good structural memory. Thus, the expansible members of the wall anchor may be fabricated in various shapes, and they will naturally regain these shapes following distortion. On one embodiment, the expansible members may be shaped to have a natural expanded radius or diameter greater than the radius or diameter of a gun barrel or chamber. This embodiment will then have a normal tendency to expand within a bore or chamber to effect a gripping action. On the other hand, the expansible members may be shaped to have a natural contracted position. In this embodiment, a wedge acts to drive the expansible members into a locking position. When unlocked, however, the members then strive to return to their natural contracted position.

The expansible members may conveniently be fingers or arms that possess small flanges, nubs, protrusions or other types of gripping surfaces or features at the outer ends or tips.

Various mechanisms may be employed to retract a wall anchor from its expanded, anchored position within a gun barrel or chamber. A simple approach lies in forcing a small end of the key member through the outer end of the locking member against the wedge so as to dislodge the wedge from the expansible members. To this end, a spring may be attached to the outer or trailing end of the wedge member and extend toward the trailing end of the locking member. Thus, when the leading end of a key member is inserted into the trailing end of the locking member so as to engage the locking member, the loading end of the key member may also compress the spring and thereby transmit force via the spring against the wedge.

The wedge has flanges that protrude from its sides and rub against the interior the barrel as the locking member travels through the barrel the firearm. The rubbing action provides resistance against the axial extraction force exerted on the locking member by the key rod as the locking member is pulled through the open end of the barrel. This resistance helps disengage the wedge from the locking member.

The flanges on the wedge also act as stops to prevent the wedge from traveling too far into the locking member. The flanges fit between the fingers of the locking member. The axial progression of the wedge into the locking member stops when the flange on the wedge engages the base of the gap formed between adjacent fingers.

Manipulation of the locking members to a locked position or to an unlocked position is preferably performed with a key member such as described above. A preferred key member is one which cooperates with a spring or other elastically resilient member in the body member. Thus, a spring or the like may be positioned within the body between the wedge and the trailing end of the body. Compression of the spring may then be employed to help force the wedge out of engagement with the wall anchor members when in their expanded position. Complete separation of the wedge from the body may be prevented by suitable shoulders or tapered surfaces within the body.

The key member is conveniently employed to disengage the wall anchor assembly from within a firearm, and thereby enable the locking member to be withdrawn from the firearm. Thus, the key member may be configured at its leading end to releasably engage or couple with the trailing end of the locking member. Once engaged with a locking member of the spring type mentioned above, for example, an axial force may be applied by the key member to the spring member; and the spring force may disengage the wedge and cause retraction of the wall anchor mechanism. The key member may then be employed to withdraw the locking member from the firearm.

GENERAL DESCRIPTION OF INVENTION

The present invention comprises an improvement over existing firearm locking methods and apparatus which is less susceptible to failure and external tampering, and also provides quick visual verification that the firearm is locked. The present invention is inserted into the open end of the barrel of a firearm. In a preferred form, a key rod contacts the locking member and urges it into position inside the chamber of a revolver, semi-automatic pistol or the like. The locking member may conveniently be positioned just outside the chamber of a revolver by engaging the lip formed by the forcing cone adjacent the chamber. Alternatively, the locking member may be positioned adjacent the chamber of a semi-automatic weapon by engaging the lip formed by the junction of the chamber and the bore.

The locking member comprises a wedge member and a set of radially expanding fingers or other anchor members protruding from a cylindrical member. The expanding members are preferably made of an elastic, flexible and tough material such as Nylon-6 so that the protruding anchor members are elastically flexible. The cylindrical body of the expanding member is slightly smaller than the inner diameter of the firearm barrel and the chamber to facilitate entry into the chamber. A shaped flange or lobe preferably extends from the tip end of each finger or anchor member and perpendicularly to the longitudinal axis of the locking member. The diameter of a circle formed by a full angular rotation of a radius measured from the longitudinal axis of the locking member to the outermost surface of the expanded anchor member is greater than the inner diameter of the bore or chamber. As the locking member travels down the bore, the flexible fingers may be constructed to press against the inside of the bore seeking to expand to their natural diameter which is larger than the diameter of the bore. This seeking facilitates a secondary locking mechanism as the anchor members expand to engage the lips formed by the junction of the bore and the chamber or forcing cone which both have a larger diameter than the bore. Flexible tips of the anchor members may be designed to compress so as to facilitate the locking member's entry into the smaller diameter of the gun barrel.

In one application of the key rod, this member is made to travel along the bore of the barrel and to urge the locking member toward the chamber. In an initial or primary locking mode, the wedge at the end of the locking member engages and stops against either the head of a bullet in a revolver or a the back of an empty chamber in a revolver or a semi-automatic weapon. The resulting resistance to the advancing key rod drives the wedge into the locking member, thereby causing the expansible wall anchor members of the locking member to expand and spread radially. The wedge also penetrates the locking member, until the wall anchor members firmly grip the interior surface of the surrounding chamber. At this point the locking member is firmly wedged in place and the key rod may be removed. The firearm is now locked.

The locking member is longer than the chamber of a revolver, so that the locking member protrudes out of the chamber and into the bore of the revolver barrel. The locking member thereby prohibits rotation of the cylinder; and the locked revolver cannot be cocked or fired so long as the locking member is in this position. The cylinder of a revolver cannot even be rotated away from the body of the revolver for loading or unloading, because the chamber containing the locking member cannot be misaligned with the bore of the barrel.

In a semi-automatic weapon, the locking member is wedged in the chamber and prevents a bullet from entering the chamber. The wedge member is preferably brightly colored to facilitate visual verification that the lock is engaged in the chamber.

In a second locking mode the wall anchor members act to fix the locking device in the bore or chamber. The outer portions of the wall anchor members are preferably made of a material possessing elasticity so that the tip ends of the members follow the inner diameter of the barrel and expand into lips or recesses formed inside the bore of the barrel. The tips of the members may be machined to a blunt edge to prevent a pointed tip from getting caught in such things as the head of a flat head or a hollow point bullet.

In a revolver the forcing cone and chamber are larger than the bore and form a lip that the wall anchor members or may engage. The members expand to engage the lip so that the locking member will not slide toward the open end of the barrel. In this secondary locking position the locking member protrudes from the bore into the chamber or forcing cone disabling the firearm by blocking the cylinder's rotation.

In a semi-automatic firearm a lip is formed by the chamber which is larger than the bore of the barrel. The wall anchor members may then expand into the larger diameter of the chamber and engage the lip formed by the junction of the chamber and the bore of the barrel. The members engage the lip to prevent the locking member from advancing toward the open end of the barrel. When a bullet enters the chamber, it engages the wedge and presses it into the wall anchor members causing the locking member to become firmly wedged in place. In this position the locking member disables the firearm by preventing an automatic round from fully entering the chamber and seating on the lip formed by the chamber and the bore. The displacement of the bullet by the locking member equally displaces the slide and hammer, so that the hammer will not engage the firing mechanism and the automatic weapon cannot be fired.

The wedge member is preferably colored so that it is highly visible. It may be bright orange, for example, for day viewing or irradiant for night viewing making it easy to affirm whether or not the gun is locked. Thus, one may simply expose the chamber of a semi-automatic weapon and visually affirm the presence of the highly visible wedge to verify that the gun is locked. This is advantageous to the owner because while he can quickly inspect the firearm to ensure that it is disabled, the locking mechanism is not externally obvious to the others.

The wedge member also helps to overcome any problems created by a bullet contacting the anchor members of the locking member. Such contact might conceivably interfere with the gripping engagement of these members.

To extract the locking member and enable the firearm, the user inserts the smaller end of the key rod into the barrel so that it engages the locking member. To effect such engagement, the key rod may have features such as bulbs that engage notches inside the locking member, or it may have flanges that engage an interior shoulder of the locking member. A wedge deactivation spring is preferably attached to the end of the wedge and extends along the longitudinal axis of the locking member into a hollow casing or portion of the locking member. As the key rod enters the locking member, the end of the key rod compresses the spring. The force exerted by the compressed spring overcomes the frictional forces between the wedge surface and the inner surface of the wall anchor members and pushes the wedge out of the locking member.

After engaging the locking member with the key rod, both pieces may be removed as a single unit. The flanges formed on the side of the wedge rub against the sides of the interior of the barrel and help to disengage the wedge from the locking member. The force of the compressed spring helps to keep the wedge out of the locking member, so that the wall anchor members are no longer firmly wedged against the interior surface of the barrel. This enables the members to radially contract so that the locking member and key rod may be easily removed through the open end of the barrel as a single unit.

BRIEF DESCRIPTION OF THE DRAWINGS

For the purpose of promoting and understanding the principles of the invention, reference is now be made to the embodiment illustrated in the drawings, which form a part of the specification and are to be read in conjunction with the specification. Like reference numbers are used in the drawings to identify like parts in various views.

FIG. 4 is a perspective view of the withdrawal end of the key rod.

FIG. 5 is an elevational side view of the key rod.

FIG. 6 is an elevational view of the locking member and wedge.

FIG. 7 is an enlarged detail showing the locking member and the mating withdrawal end of the key rod, the forward end of the locking member being shown in cross section.

DESCRIPTION OF A PREFERRED EMBODIMENT

Figure 1:
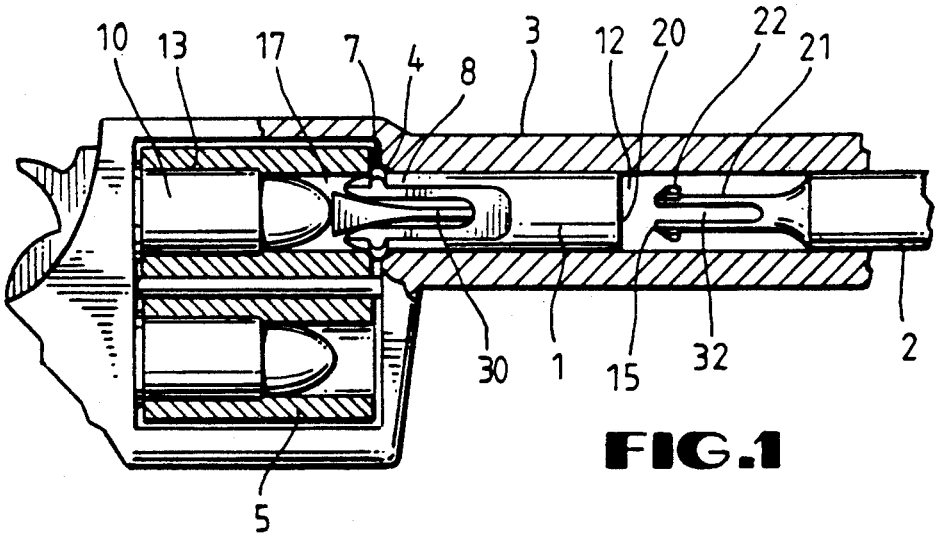
FIG. 1 is an elevational side view of a typical revolver with the barrel, cylinder, and part of the frame shown in cross section, illustrating the locking device of the present invention installed over a loaded chamber and the key rod partially inserted in the withdrawal position.

For the purpose of promoting an understanding of the principles of the invention, reference will now be made to the embodiment illustrated in the drawings and specific language will be used to describe the same. It will, nevertheless, be understood that no limitation of the scope of the invention is thereby intended. Alterations and further modifications of the illustrated device, and further applications of the principles of the invention, will be readily apparent to persons skilled in the art.

Referring to FIG. 1, there is illustrated a revolver similar to all revolvers in common use, and is intended to be representative of that class of arm, rather than a specific model.

The safety device includes a locking member 1, which is generally cylindrical and of a diameter which closely approximates that of the bore 12 of the barrel 3. One end of the locking member has a slotted fork 8 in one end from which project lobes 7 of a diameter greater than that of the bore 12 of the barrel 3. Wedge 30 fits within a groove formed in the interior surface of forks 8. Wedge 30 slides along the grooves and fits within the hollow body of the locking member 1.

The slot 9 provides sufficient relief to allow the forks 8 to move far enough toward each other to allow the lobes 7 to enter the bore 12 of barrel 3. The locking member 1 may then be farther advanced toward the chamber 14 by pushing it with the seating end 14 of the key rod 2. Wedge 30 engages the tip of cartridge 10 and forces forks 8 to expand radially until the lobes 7 are seated in the forcing cone 4. The safety device is constructed of a material, which possesses elasticity so that the forks or fingers protruding from the locking member are elastically flexible. When the lobes 7 reach the forcing cone 4, they expand into the forcing cone 4, which is somewhat larger than the bore 12 diameter, holding the locking member 1 securely in this position. The safety device will function well in this position, preventing the rotation of the cylinder 5 or any misalignment of the bore 17 of the cylinder 5 with the bore 12 of the barrel 3. This position allows a gun with a cartridge 10 in the chamber 13 that is in alignment with the bore 12 of the barrel 3 to be made safe from firing, because for the gun to be cocked, the cylinder 5 must be allowed to rotate. The cylinder 5 will not rotate or move out of alignment with the bore 12, and the gun may not be loaded or unloaded.

Figure 2:
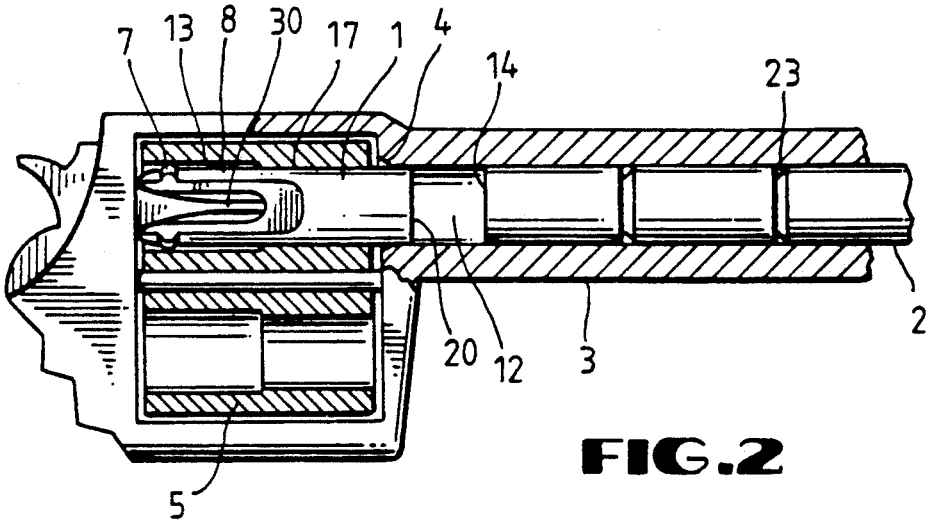
FIG. 2 is an elevational side view of a typical revolver with the barrel, cylinder and part of the frame shown in cross section, illustrating the locking device of the present invention installed in an empty chamber and the key rod partially withdrawn from the seating position.
Figure 3:
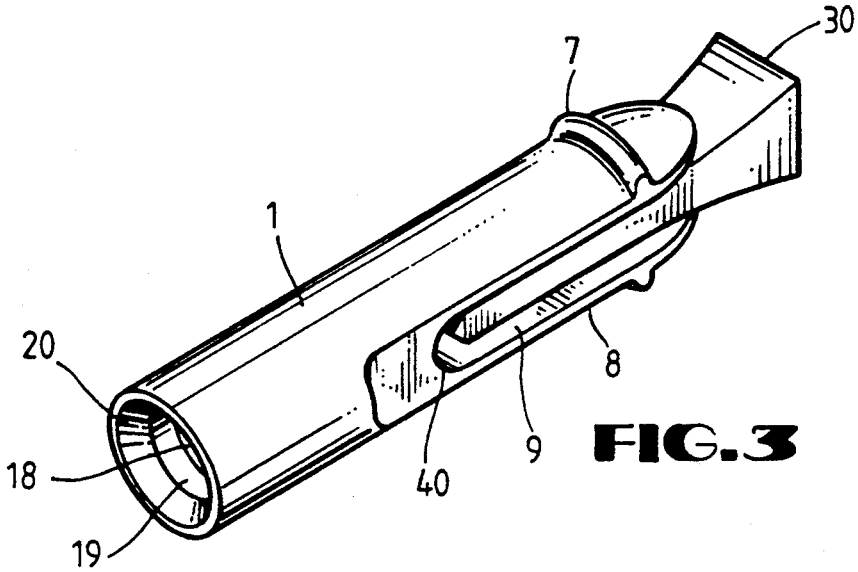
FIG. 3 is a perspective view of the locking member and wedge.
Figure 9:
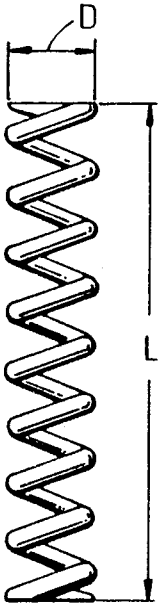
FIG. 9 is a diagram showing the external dimensions of the wedge deactivation spring.

As shown in FIG. 2, if the aligned chamber 13 is empty the locking member may be advanced farther so that the lobes 7 first enters the bore 17 of the cylinder 5 and then the aligned chamber 13. Here the lobes 7 will expand into the aligned chamber 13, holding the safety device securely in this more advanced position. When the locking member is advanced to the end of the chamber 13, the wedge 30 stops against the end of the chamber and resists the force applied by the key rod 2. The force of the key rod 2 against the body of the locking member 1 forces the forks 8 to engage the wedge 30. As the wedge 30 is forced into the locking member 1, it separates and spreads the forks 8 until the lobes 7 engage the interior of the chamber 13. This is a desirable position for the locking member 1, because it is less accessible to external tampering.

In FIG. 7 the opposite end of locking member 1 from fork 8 is shown in cross section, illustrating a recess 18 in the end of the rod with an internal flange 19 at the outer end and a tapering entrance 20 thereto. The withdrawal end 15 of the key rod 2 is equipped with a slotted fork 21, the tines of which are terminated by external lugs 22 tapered at the forward end to mate with the tapered entrance 20 of recess 18. The lugs 22 have a rear surface set at 90 degrees to the axis of rod 1, so that they may elastically expand and engage flange 19, after being forced together by being pushed into tapered entrance 20 to recess 18 in rod 1. The lock rod 1 may then be withdrawn from the bore 12 of the barrel 3.

The outside diameter of tapered lugs 22 is considerably less than diameter of bore 12, facilitating ease of introduction of key rod 2 into bore 12. Also, the diameter of key rod 2 closely approximates that of bore 12, facilitating automatic axial alignment of key rod 2 with locking member 1. Locking member 1 may be engaged and removed quickly and easily using only gross movement of major limbs with no fine coordination required, such as would be needed to manipulate, for example, a threaded coupling device.

Figure 8B:
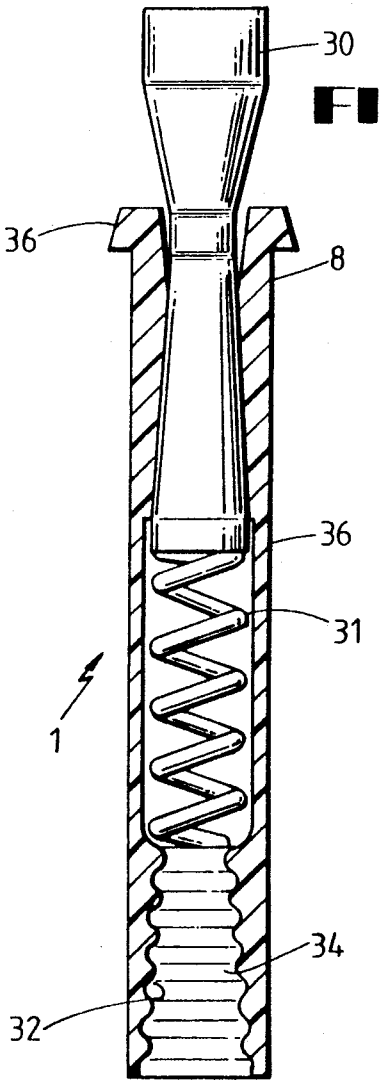
FIG. 8B is an elevational view of an alternative embodiment of the engagement means between the locking member and the key rod.
Figure 8A:
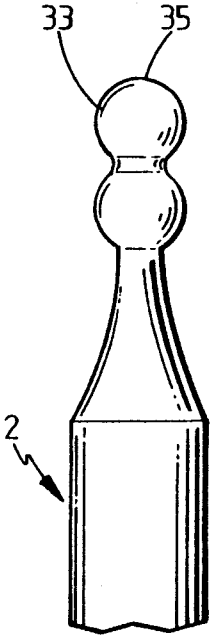
FIG. 8A is an elevational view of an alternative embodiment of the engagement means between the locking member and the key rod.

FIG. 8A and FIG. 8B illustrate an alternative embodiment of key rod 2 and extraction mating with the locking member. In this embodiment the interior of the extraction end of the locking member 1 consists of six notches 32. Each successive one of the notches 32 has a smaller diameter than the previous notch, so that as the extraction bulbs 33 are inserted into the locking member casing the bulbs engage the notches 32. The bulbs 33 are frictionally held in place by notches 32 so that the key rod 2, locking member 1 and wedge 30 may be removed as a single unit.

As shown in FIG. 8A and FIG. 8B when the wedge 30 enters the forks 8, the wedge deactivation spring 31 extends through the hollow interior of the locking member casing 36. The end of the wedge spring extends into the locking member space 34 until it is near the open end of locking member space 34. As the key rod bulbs 33 enter the locking member space 34 and engage successive notches 32 the end 35 of the key rod 2 compresses wedge deactivation spring 31. The wedge deactivation spring 31 pushes against wedge 30 with sufficient force to overcome the friction between wedge 30 and the interior surface of forks 8 and locking member casing 36.

Figure 10C:
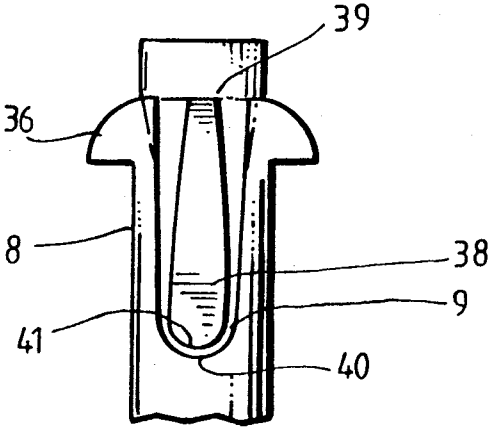
FIG. 10C is a perspective view of the wedge and flanges protruding from the wedge.
Figure 10B:
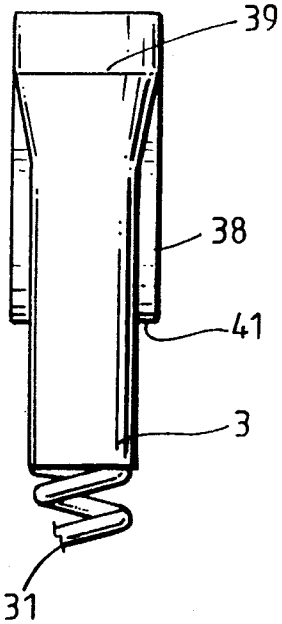
FIG. 10B is a perspective view of the wedge and flanges protruding from the wedge.
Figure 10A:
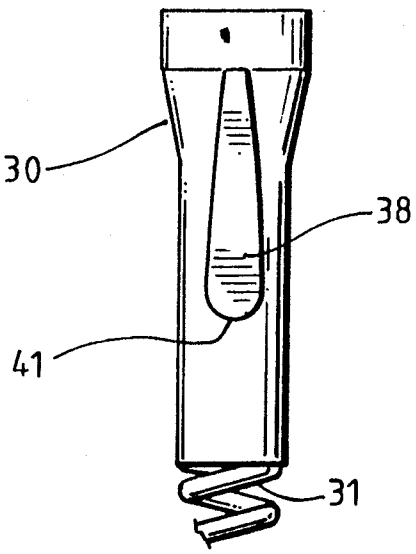
FIG. 10A is a perspective view of the wedge and flanges.

As the locking member 1 is withdrawn from the barrel by key rod 2, the force of the wedge deactivation spring 31 and the resistance of flange 38 rubbing against the interior of the barrel 12 helps to force the wedge 30 out of the forks 8 and facilitates the radial contraction of the forks 8 so that the locking unit may be easily removed. As shown in FIGS. 10A, 10B and 10C, Flange 38 fits into the slot 9 formed between the adjacent forks 8. Flange 38 stops the progress of the wedge 30 into the locking member 1 when the end 41 of flange 38 abuts the base 40 of slot 9. The wedge 30 is brightly colored to facilitate visual verification that the locking member is installed in the chamber of a semi-automatic weapon by looking into an exposed chamber.

The forks 8 may have lobes 7 or flanges 36. The lobes 7 engage the forcing cone 4 of a revolver. Flanges 36 engage the lip formed by the junction of the bore and the larger diameter chamber in a revolver or semi-automatic weapon. Both lobes 7 and flanges 36 engage to prevent the locking member 1 from traveling down the barrel and inadvertently unlocking the firearm. The key rod 2 may be manufactured in a length sufficient to accommodate the longest barrel encountered.

Since many possible embodiments may be made of the invention without departing from the scope thereof, it is to be understood that all matter herein set forth or shown in the drawings, is interpreted as illustrative and not in a limiting sense. It will be understood that certain features and subcombinations are of utility and may be employed without reference to other features and subcombinations. This is contemplated by and is within the scope of the claims.

What is claimed is:

1. A safety device for locking a firearm against being fired when the firearm has a barrel and a chamber alignable with the barrel, which comprises:

an elongated locking member having a leading end and a trailing end and sized to enter and move through said barrel into said chamber, said locking member including (a) an expansible portion proximate the leading end of the locking member and configured upon expansion to anchor against the inner surface of the barrel or the chamber; and (b) a displaceable member in the leading end of the locking member operable to expand said expansible portion;

said locking member being sufficiently longer than said chamber to be positioned partly in said chamber and partly in said barrel when said expansible portion is anchored against said barrel or said chamber;

a key member having a leading end and a trailing end and sized to enter said barrel, said key member configured at its leading end to engage the trailing end of the locking member; and a means within the locking member operable to release said expansible portion from being anchored against said barrel of said chamber wherein said means comprises spring interposed between said key member and said displaceable member.

2. The safety device of claim 1 further wherein said expansible member has tapered lugs at the end of an elastic finger.

3. The safety device of claim 1 wherein said expansible member has tapered lugs at the end point of leading edge of said expansible portion.

4. A method for a locking a firearm having a barrel and a cylinder including a chamber alignable with the barrel, said method comprising the steps:

inserting a locking member sized to move through said barrel into said chamber, said locking member being longer than the length of said chamber;

engaging a recess inside said chamber with an elastically expansible portion configured to engage the inner surface of said chamber of said barrel following movement of a leading end of the locking member into said barrel;

inserting a key rod through said barrel, said key rod sized to move through said barrel and configured at a leading end to engage the trailing end of said locking member when the locking member is engaged to said chamber of said barrel; said key rod being sufficiently long to extend outside said barrel when the leading end of the key rod is in engagement with the trailing end of the lock rod; and engaging a wedge member against the back end of said chamber or against a bullet occupying said chamber and causing said wedge member to expand said expansible portion of said locking member.

* * * * *